US005287078A

United States Patent [19]

Larson

[11] Patent Number: 5,287,078

[45] Date of Patent: Feb. 15, 1994

[54] SAFETY FUSE APPARATUS FOR SOLID STATE POWER CONTROLLERS

[75] Inventor: Eric K. Larson, Narragansett, R.I.

[73] Assignee: Texas Instruments Incorporated, Dallas, Tex.

[21] Appl. No.: 985,407

[22] Filed: Dec. 4, 1992

[51] Int. Cl.[5] ..... H01H 85/02

[52] U.S. Cl. ..... 337/184; 337/183; 337/295

[58] Field of Search ..... 337/180, 181, 182, 183, 337/184, 185, 186, 290, 295

[56] References Cited

U.S. PATENT DOCUMENTS 3,030,473 4/1962 Liker ..... 337/184

*Primary Examiner*—Harold Broome

*Attorney, Agent, or Firm*—Russell E. Baumann; Richard L. Donaldson; René E. Grossman

[57] ABSTRACT

A back-up safety device is shown for use with a power controller to prevent damage to circuits with which the controller is used in the event that the controller malfunctions. The safety device has performance characteristics which conforms to selected circuit breaker time-current curves so that it does not interfere with normal operation of the controller. The safety device is surface mountable on the same substrate on which the controller is disposed.

13 Claims, 3 Drawing Sheets

SAFETY FUSE APPARATUS FOR SOLID STATE POWER CONTROLLERS

FIELD OF THE INVENTION

This invention relates generally to solid state power controllers for use in aircraft power distribution systems and the like and more particularly to safety fuse apparatus for use with such controllers.

BACKGROUND OF THE INVENTION

Conventionally, in power distribution systems such as those used in aircraft, each load circuit incorporates both a relay for switching and a thermal circuit breaker to protect the circuit wiring such circuit breakers are covered by military specification Mil-C-5809/1 if they have a dual or safety fuse feature. Also referenced in these circuit breaker specifications are trip curves designated MS3320 made from tabulated results for percent current overload versus time. The relay and circuit breaker for many circuits are located in cockpit for flight crew operation requiring heavy gage wire to run from the generator to the cockpit and then to the load resulting in a substantial weight penalty. A solid state power controller of the type shown and described in copending application Ser. No. (Attorney Docket No. 18437) assigned to the assignee of the present invention replaces both the relay and the circuit breaker in the power distribution system, providing both functions in a single device. It can also be remotely mounted to decrease wire weight and computer controlled to reduce flight crew workload.

Thermal circuit breakers incorporate a bimetallic element to sense the resistive heating of wire and cable due to current flow therethrough. A key inherent characteristic of the bimetal is "thermal memory". The bimetal stores and dissipates the heat energy in the same manner as the circuit wire and cable, and reduces circuit breaker trip time when the wire temperature remains elevated from a previous overload condition. This protects the wire and cable when exposed to multiple overloads or preload conditions by maintaining the heat energy below the threshold for wire damage. The thermal circuit breakers also allow momentary high inrush currents such as motor loads, charging capacitive loads and lamp loads without nuisance tripping. These circuit characteristics are incorporated in the referenced solid state power controller which functions as a thermal analog to wire and cable by following the MS3320 trip time versus overload current relationship while also performing relay functions. The MS3320 time-current curve parallels standard wire damage curves, enabling optimization of wire size and ampere rating. Additionally, during a short circuit or high level overload, the controller limits the circuit current to a preset limit and maintains it, tripping only when the rated maximum safe allowable temperature of the controller is reached.

In the event that the power controller does not operate as intended there is a need to provide a back-up safety mechanism to ensure that the protected circuits are not damaged by an overload condition without interfering in the normal operation of the power controller.

The power controller described and claimed in the above referenced application comprises a substrate mounting hybrid components in a package which, for a single controller, is in the order of two inches in length, one and a third inches in width and a third of an inch in height.

It is known to use fuse devices as a back-up safety mechanism for various electrical apparatus; however, such conventional fuse devices are not suitable for use with power controllers of the type described above. Typical prior art fuses do not conform to the MS 3320 time-current curve and would blow out in response to various overload conditions which by design the controller allows. The purpose of the back-up safety device is to blow out only in the event that the controller malfunctions and not to interfere with the normal operation of the power controller. Other devices which may conform to the MS3320 time-current curve are either too large in size to fit within the controller package or are not compatible with the surface mount assembly techniques.

SUMMARY OF THE INVENTION

It is therefore an object of the present invention to provide a safety back-up mechanism which is compatible with the power controller referenced above, that is, a safety mechanism which conforms to the performance criteria of the power controller. Another object is the provision of a back-up safety device of low cost and of small size, one which can be mounted in the same package as the power controller without adding significantly to the size of the package. Yet another object is the provision of a safety back-up device which can be surface mounted in a hybrid assembly. Another object of the invention is the provision of a slow blow back-up safety fuse which is adapted for use with a power controller conforming to the MS3320 time versus percent overload current and which is small in size and yet can be used with various different current ratings.

Other objects and advantages of the present invention will become more fully apparent from the following detailed description when read in conjunction with the accompanying drawings.

Briefly, in accordance with the invention, a back-up safety device particularly adapted for use with solid state power controllers having performance characteristics conforming to MS3320 time-current curves and of a size sufficiently small to fit within the package housing such controllers without having to enlarge the package comprises a heater element divided into two equal parts separated by a short distance with an end of each part electrically and thermally connected together by a fusing element. The ends of the heater element parts provide for a connection between the power line and the power controller. The heater element is selected having a relatively high electrical resistivity and a low thermal diffusivity to provide the required thermal time constant, with adequate temperature rise, to be obtained in a small space. The fusing element is selected having a high thermal diffusivity and conductivity, low electrical resistivity and a lower melting point than the heater material. According to a feature of the invention the heater is formed of two identical U-shaped elements, preferably of alloy 42 (42% nickel and the balance iron), having their bights mounted in a body of high temperature epoxy with first legs adapted to be surface mounted as by soldering on respective circuit traces on a substrate and second legs extending in parallel relationship and in cantilever fashion with a copper fusing element connecting the outer distal free ends of the second leg. According to a feature of the invention the back-up safety device has virtually the same overall dimensions for a range of different current ratings.

DESCRIPTION OF PREFERRED EMBODIMENTS

Figure 1:
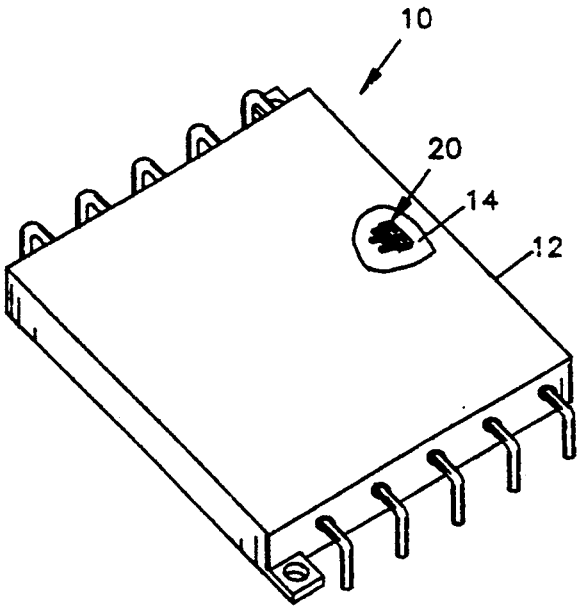
FIG. 1 is a perspective view of a solid state power controller partly broken away to show a back-up safety device made in accordance with the invention.

As seen in FIG. 1 a solid state power controller 10 is shown comprising a package 12 containing a substrate 14 on which is disposed circuit traces as well as various hybrid components (not shown) including, for example, resistors, capacitors, FETS and ASICS. A back-up safety device 20 is disposed in package 12 and is surface mounted to circuit traces on substrate 14 by conventional hybrid surface assembly techniques, such as by soldering.

Figure 2:
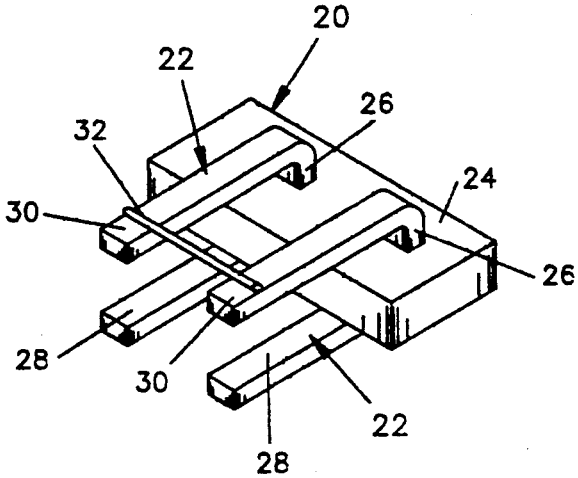
FIG. 2 is an enlarged perspective of the back-up safety device shown in FIG. 1.

With reference to FIG. 2, safety device 20 comprises first and second heater elements 22 mounted in spaced apart relation on body 24 formed generally as a parallelepiped of suitable electrically insulative material such as EPO-TEK, H77-T, a high temperature epoxy provided by Epoxy Technology Inc.

Heater elements 22 are identical to one another and are generally U-shaped rectangular elements with their bight portions 26 received in body 24 and first legs 28 adapted to be surface mounted, as by soldering, on traces on substrate 14 adapted to be coupled to the power line and to the power controller respectively. Second legs 30 extend parallel to one another in cantilever fashion from body 24 and mount a fuse element 32 a certain distance from the free distal ends of legs 30 to provide heater legs of a length selected to provide the desired amount of heating.

The heater element material is selected having a relatively high electrical resistivity and a low thermal diffusivity in order to provide in a small space the required time constant, with adequate temperature rise, to conform to the MS3320 time-current curve. A back-up safety device 20 has been made in accordance with the invention using both steel and alloy 42 with alloy 42 being preferred since it provides a slightly smaller footprint for the device while having the desired surface mounting soldering characteristics. The fusing element material is selected having a high thermal diffusivity and conductivity, low electrical resistivity and a lower melting point than the heater material. Copper has been found to be satisfactory for the fusing element material and can be resistance welded to the heater leg providing a solid connection therebetween. Preferably, the fuse heater elements are solder coated to allow for reflow solder attachment to the substrate traces and to allow for better electrical joint integrity of the fusing element to the heater element. The $I^2R$ heating generated in the fusing element is designed to be relatively small compared to that generated in the heater which allows for the rate of temperature rise of the effective center to be governed essentially by the two part heater element. The high thermal conductivity of the fusing material, along with its short length, permit the generated heat to be conducted out of the fusing element into the heater elements very quickly. The rate at which the fusing temperature is reached will therefore primarily be due to the heater elements and the required fusing temperature will be governed by the fusing element.

Figure 3:
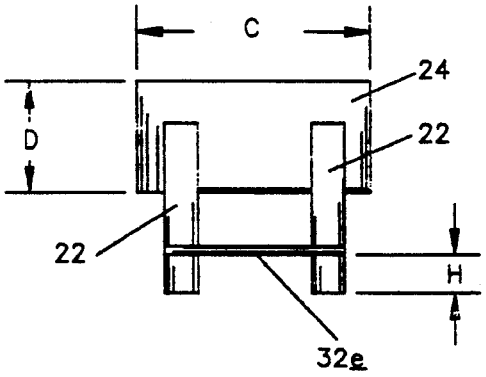
FIGS. 3–5 are top, front and side views respectively of the FIG. 2 device.
Figure 4:
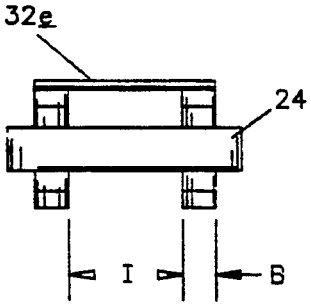
Figure 5:
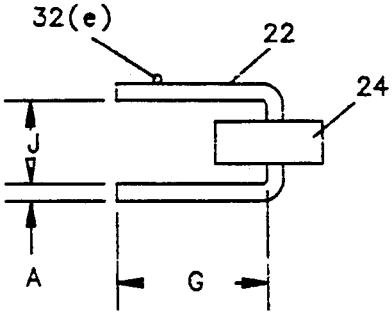

Devices made in accordance with the invention adapted for use with different current ratings have generally the same overall dimensions. The spacing and length of the heater elements 22 are the same with the thickness of the material and in certain ratings the width of the material being changed to provide the desired electrical and thermal characteristics. The following table gives dimensions in inches for several different ampere ratings as shown in FIGS. 3–5.

| Rating | A | B | C | D | E (Wire Gage) |
|---|---|---|---|---|---|
| 10.0 | .041 | .082 | .305 | .145 | .0126 |
| | .039 | .078 | .295 | .135 | 28 gage |
| 7.5 | .041 | .062 | .255 | .145 | .01 |
| | .039 | .058 | .245 | .135 | 30 gage |
| 5.0 | .021 | .082 | .305 | .125 | .0089 |
| | .019 | .078 | .295 | .115 | 31 gage |
| 2.5 | .021 | .042 | .255 | .125 | .0063 |
| | .019 | .038 | .245 | .115 | 34 gage |
| G for all the above ratings is | | | .165 | | |
| | | | .155 | | |
| H for all the above ratings is | | | .060 | | |
| | | | .040 | | |
| I for all the above ratings is | | | .080 | | |
| | | | .070 | | |
| J for all the above ratings is | | | .090 | | |
| | | | .100 | | |

Figure 6:
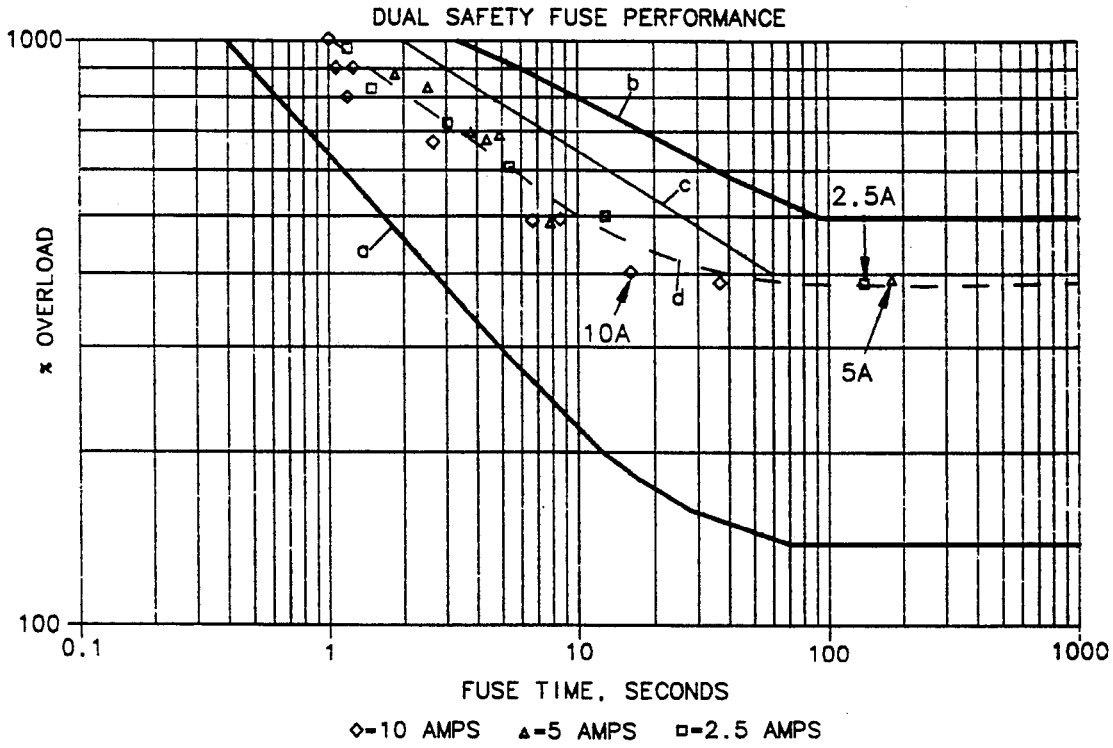
FIG. 6 is a graph showing fuse time versus percent overload current and showing the performance of several devices made in accordance with the invention but having different current ratings.

As seen in FIG. 6, curve a is the upper or maximum trip curve for the solid state power controller shown in FIG. 1 which conforms to the MS3320 curve while curves b and c are the upper design limits as determined by military specification for trip free, dual safety aircraft circuit breakers MIL-C-5809/1. Dash L line curve d represents the results of 2.5, 5 and 10 amp back-up safety devices made in accordance with the invention showing the test points within the selected maximum and minimum allowable values.

It will be understood that devices can be made for other ratings by selecting appropriate dimensions. Further, use of different materials, such as steel as mentioned above, will result in further changes in dimensions in order to provide performance depicted in FIG. 6.

While there has been illustrated and described what at present is considered to be the preferred embodiments of the invention it will be understood by those skilled in the art that various changes and modifications may be made and equivalents may be substituted for elements thereof without departing from the true scope of the invention. It is intended that the invention will include all embodiments falling within the scope of the appended claims.

We claim:

1. Apparatus for providing back-up protection to selected circuits which will open the circuit in response to current in the circuit exceeding time versus percent overload current defined by the maximum trip curve of aircraft circuit breaker performance data in MS3320 comprising a body formed of electrically insulative material, first and second identical, generally U-shaped heater elements, having first and second legs joined by a bight portion, the bight portion being mounted on the body so that the U-shaped elements are spaced from one another and with the legs of the first element extending generally parallel to the legs of the second element, the first legs being adapted to be surface mounted to respective first and second traces on a substrate, the second legs extending in cantilever fashion beyond the body and having free distal end portions, and a fusing element connecting the first and second heater elements adjacent the free distal end portions thereof.

2. Apparatus according to claim 1 in which the heater elements are formed of an alloy of 42 percent nickel and the balance iron.

3. Apparatus according to claim 1 in which the heater elements are formed of steel.

4. Apparatus according to claim 1 in which the fusing element is formed of copper.

5. Apparatus according to claim 1 in which the fusing element is welded to the respective heater elements a selected distance from the free distal ends of the elements.

6. An apparatus for providing back-up protection to selected circuits which will open the circuit in response to current in the circuit exceeding selected time versus percent overload current comprising a body formed of electrically insulative material, first and second identical heater elements mounted on the body and spaced from one another, the elements having first and second legs joined by a bight portion and said second legs having a free distal end portion, a fuse element connecting the distal free end portions of the first and second elements, and means to connect the heater elements respectively to a selected circuit to be protected and to a power source.

7. Apparatus according to claim 6 in which the body is generally a parallelepiped having top and bottom surfaces and a portion of the bight portions are embedded in the body with the first and second legs spaced from and extending generally parallel to the respective upper and bottom surfaces.

8. Apparatus according to claim 7 in which the body is formed of a high temperature epoxy.

9. Apparatus according to claim 7 in which the heater elements are formed of an alloy of 42 percent nickel and the balance iron.

10. Apparatus according to claim 7 in which the heater elements are formed of steel.

11. Apparatus according to claim 7 in which the fusing element is formed of copper.

12. Apparatus according to claim 7 in which the first legs are adapted to be soldered to traces of a substrate and the second legs have the free distal end portions to which the fusing element is connected.

13. Apparatus according to claim 12 in which the fusing element is attached to the heater elements a selected distance from the free distal end portions of the elements.

* * * * *